US006402182B1

(12) United States Patent
Noviant

(10) Patent No.: US 6,402,182 B1
(45) Date of Patent: Jun. 11, 2002

(54) SKI OR OTHER SNOWBOARD COMPRISING RIGID, DISTINCT SIDE WALLS AND PROCESS FOR PRODUCING SUCH SIDEWALLS

(75) Inventor: Jerôme Noviant, Voiron (FR)

(73) Assignee: Skis Rossignol, Voiron Cedex (FR)

( * ) Notice: Subject to any disclaimer, the term of this patent is extended or adjusted under 35 U.S.C. 154(b) by 0 days.

(21) Appl. No.: 09/656,453

(22) Filed: Sep. 6, 2000

(30) Foreign Application Priority Data

Sep. 9, 1999 (FR) ..... 99 11488

(51) Int. Cl.[7] ..... A63C 5/00
(52) U.S. Cl. ..... 280/610; 280/608
(58) Field of Search ..... 280/602, 608, 280/609, 610

(56) References Cited

U.S. PATENT DOCUMENTS 3,816,573 A * 6/1974 Hashimoto et al. ..... 280/602
3,967,992 A 7/1976 McCaskey, Jr. et al.
4,093,268 A 6/1978 Sampson et al.
4,455,037 A 6/1984 Pilpel et al.
4,545,597 A * 10/1985 Meatto et al. ..... 280/610
5,292,148 A * 3/1994 Abondance et al. ..... 280/602
5,496,053 A 3/1996 Abondance

FOREIGN PATENT DOCUMENTS

DE 4033780 5/1991

OTHER PUBLICATIONS

"Plastics Processing Data Handbook", 2nd Edition, Rosato, dated Dec. 1997.*
"Plastics", 5th Edition, DuBois and John, dated Dec. 1974.*
Internet Web Site www.aist.go.jp Printout Titled "Gradient Composite. . . ", dated Dec. 1997.*
Internet Web Site info.lu.farmingdale.edu Titled "Composites" dated Nov. 1999.*
Internet Web Site www.britannica.com Titled "noble metal" not dated.*

* cited by examiner

*Primary Examiner*—Brian L. Johnson
*Assistant Examiner*—Bryan Fischmann
(74) *Attorney, Agent, or Firm*—Browdy and Neimark

(57) ABSTRACT

A ski or other board for gliding over snow has two lateral, longitudinal edges constituted by rigid, distinct elements called "sidewalls", which comprise a multitude of discrete metallic inclusions incorporated therein and distributed in their structure, made of corrosion-proof metal of shiny appearance. Such sidewalls are made of thermosettable or thermoplastic polymer materials.

10 Claims, 2 Drawing Sheets

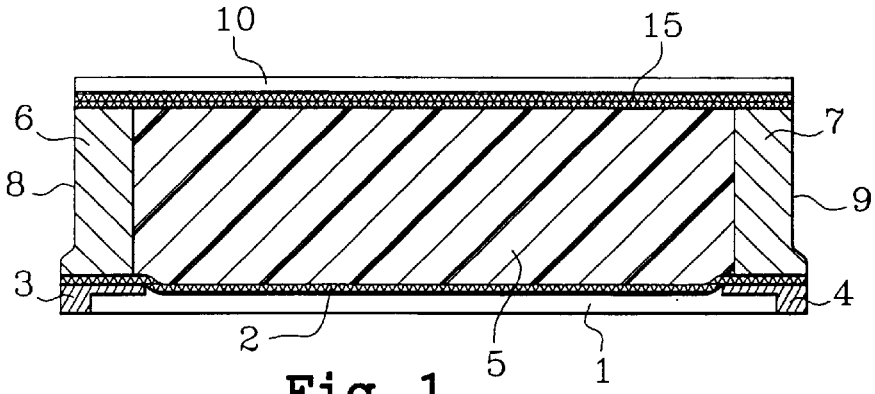
Fig. 1
PRIOR ART
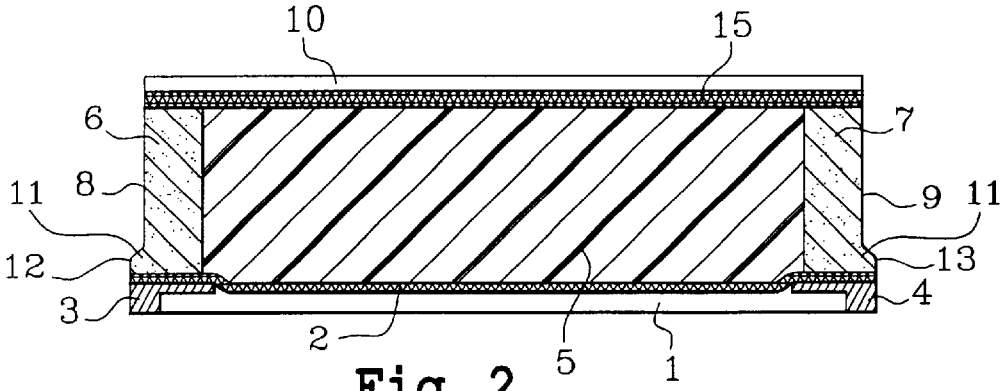
Fig. 2
Fig. 3
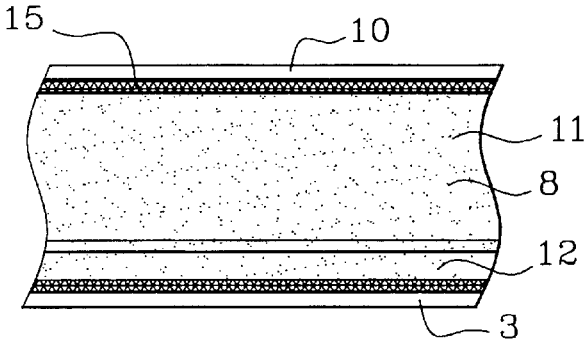
Fig. 4
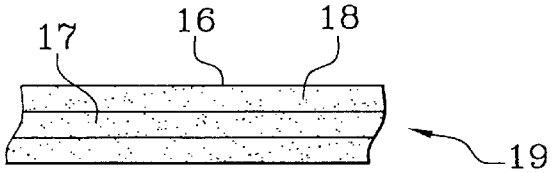

SKI OR OTHER SNOWBOARD COMPRISING RIGID, DISTINCT SIDE WALLS AND PROCESS FOR PRODUCING SUCH SIDEWALLS

FIELD OF THE INVENTION

The present invention relates to a ski, or other board for gliding over snow, comprising rigid, distinct sidewalls, materialized by rigid reinforcing elements in the form of longitudinal strips.

This invention also relates to a process for making rigid, distinct sidewalls in the form of rigid reinforcing elements.

BACKGROUND OF THE INVENTION

FIG. 1 of the accompanying drawings schematically shows, in transverse section, a conventional ski.

This ski presents;

- a lower assembly comprising a sole 1 for gliding over snow, this sole 1 being bordered on either side by lateral metal edges 3 and 4; this assembly is surmounted by a fibrous reinforcing layer 2;
- a core 5 surmounting this lower assembly, and bordered on either side by two rigid, longitudinal reinforcing elements, so called sidewalls 6, 7; and
- an upper assembly comprising a fibrous reinforcing layer 15, surmounted by a plastic upper layer 10 for protection and decoration.

The two sidewalls 6, 7 lie above the lower assembly and their thickness is appreciable. The outer layer faces 8, 9 of the two rigid sidewalls 6, 7 form at least a part of the lateral faces of the ski.

The two lateral sidewalls 6, 7 are intended to:

- directly transmit efforts from the user's foot to the snow; in particular, they avoid "crushing" of the different stacked components in the ski structure when the ski is subjected to stress; in effect, the force of impulsion generated by the skier, in particular when making a bend, tends to crush the ski between his/her feet and the snow; such crushing is translated by a loss of reaction time and a loss of energy, therefore by a loss of efficiency;
- consolidate the strength of the metal edges within the ski structure; during use, the ski is often treated roughly by the presence of stones on the slopes; if the bearing above the edge is not firm enough, the edges subside or are torn in the event of considerable shock;
- reinforce the ski structure in bending and in torsion, with lateral sidewalls 6, 7 presenting a high Young's modulus; the stiffness is improved and improved resistance to breaking is obtained;
- reinforce the resistance of the sidewalls of the ski to abrasion; the sidewalls of an alpine ski are subjected to the abrasion of the snow, to wear by friction against obstacles encountered on the slope (trees, rocks, . . . ) and to the aggression of the edges of the other ski of the pair;
- participate in the aesthetic appearance of the ski; the sidewalls of the ski are a zone visible to all.

A conventional ski therefore comprises sidewalls, or lateral reinforcing elements, or rigid longitudinal reinforcing elements, located on either side of a central core and disposed above the metal edges.

These longitudinal elements may present a length substantially equal to, or shorter than, the supporting length of the ski. Similarly, the height of these longitudinal elements may correspond to the total height of the ski or may be less than this height.

These longitudinal elements thus respond to a need for consolidation of at least one zone of the ski subjected to considerable pressures or stresses.

It is known, for example by U.S. Pat. Nos. 3,967,992, 4,093,268 and 4,455,037, to make skis with reinforcing elements corresponding in dimensions to the lateral surfaces of the skis, i.e. having substantially the length and height of the ski.

Other intermediate solutions comprising localized reinforcing elements exist, for example as disclosed in Applicant's Patents FR-2,683,734 and FR-2,703,915.

These lateral reinforcing elements are of different natures, and different processes enable them to be obtained.

For producing skis or like boards comprising metallic lower edges, two forms of reinforcing elements are found at the present time:

- a stratified composite, with thermosettable resin based on phenol or melamine, for example,
- an extruded then injected thermoplastic polymer material, such as Acrylonitrile-Butadiene-Styrene (A.B.S.) for example.

It is an object of the present invention to provide a ski, or other snow board, of which the characteristics are optimized by the use of improved lateral reinforcing elements.

The two lateral and longitudinal faces of a ski, or other snow board, are constituted by distinct, rigid, longitudinal elements called "sidewalls".

SUMMARY OF THE INVENTION

According to the present invention, the ski or other snow board is characterized in that these sidewalls comprise corrosion-proof metal particles incorporated therein and distributed in their structure.

These particles or inclusions may typically be metallic balls with a maximum diameter of 100 $\mu$m, or metallic flakes whose length may vary between 5 and 100 $\mu$m, and they are arranged discretely in the structure of said sidewalls. They are preferably made of a noble metal of relatively low density with respect to steel. Titanium or zirconium, of shiny white appearance, or gold, of shiny gold appearance, may for example be cited by way of metal used for these inclusions.

According to a second aspect of the invention, a process for producing rigid, distinct sidewalls intended for a ski or snow board comprises covering a thin sheet of paper with a layer of thermosettable resin, sprinkling this layer of thermosettable resin with metallic particles, repeating these latter two steps a number of times in order to obtain a stack of coated sheets, compressing this stack and triggering off polymerization of the resin, and cutting out the stack to the dimensions of the sidewalls.

According to a third aspect of the invention, a process for producing rigid, distinct sidewalls for a ski or other snow board comprises the steps consisting of incorporating metallic particles with the granules of polymer materials, extruding them and cutting out the molded plates obtained to the dimensions of the sidewalls.

BRIEF DESCRIPTION OF THE DRAWINGS

The invention will be more readily understood on reading the following description of a non-limiting form of embodiment thereof, with reference to the accompanying drawings, in which:

FIG. 1 which has already been referred to, schematically shows a ski according to the prior art.

FIG. 2 is a transverse section through a ski according to the invention.

FIG. 3 is a partial side view of this same ski.

FIG. 4 is a schematic section through a stratified composite which may be used for producing a ski according to the invention.

DESCRIPTION OF PREFERRED EMBODIMENT

Figure 5:
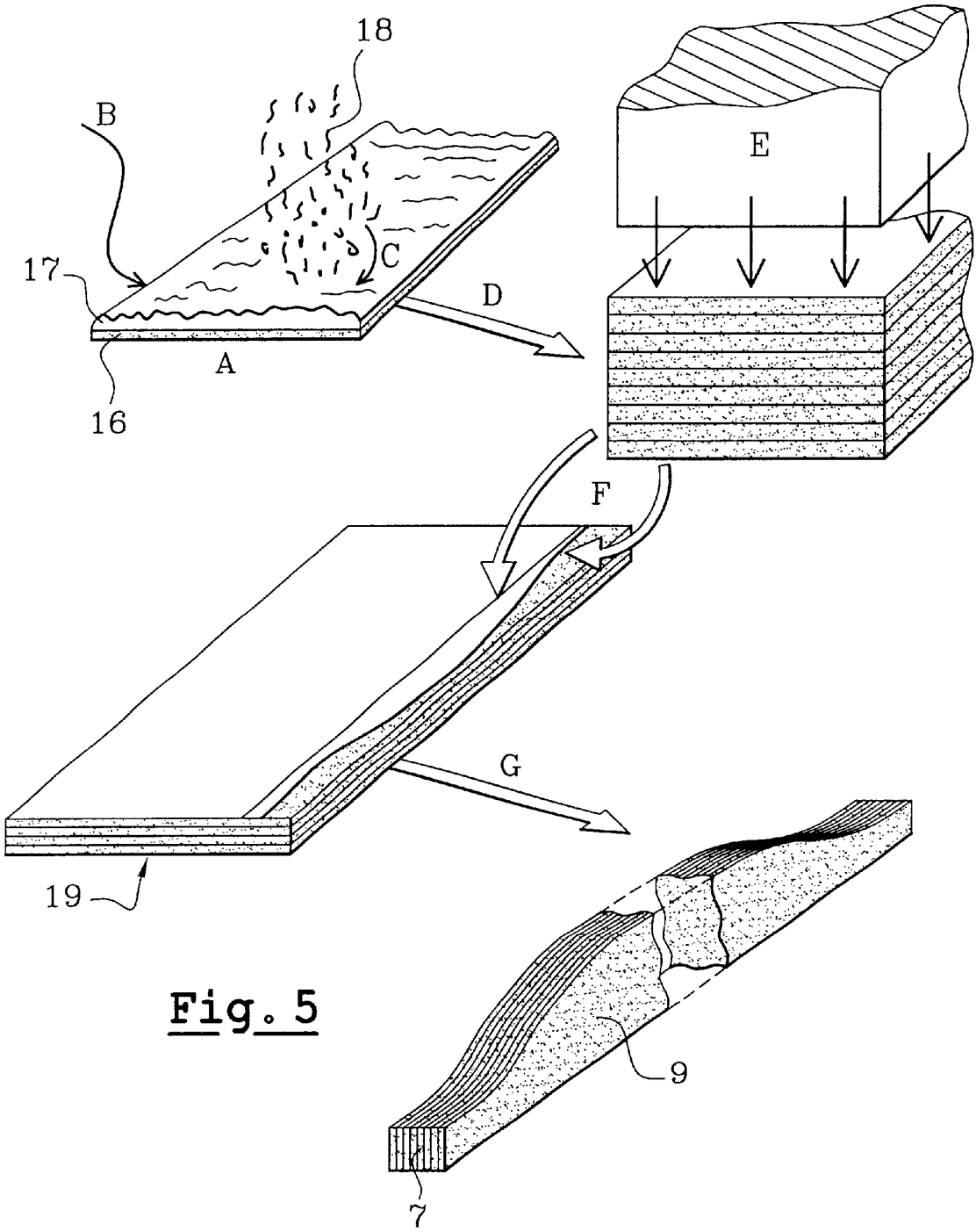
FIG. 5 is a schematic view of the different steps A–G of the process for producing the sidewalls.

Referring again to the drawings, FIGS. 2 and 3 differ from a conventional ski according to FIG. 1 in that its sidewalls 6, 7 comprise, incorporated therein and distributed within their structure, a multitude of metallic inclusions 11 constituted in the present case by flakes of titanium whose length is typically included between 5 and 100 $\mu$m.

If these sidewalls 6, 7 are made by cutting out a plate 19 of stratified composite according to FIG. 4, the invention consists see (FIG. 5), for making the plates 19, in depositing a thin sheet of paper 16 (step A), in covering it with a layer of thermosettable liquid resin 17 (step B), in sprinkling this layer of liquid resin with metallic flakes 18 (step C), then in repeating this operation numerous times in order to obtain a stack of coated sheets (step D), finally in compressing this stack in order to trigger off polymerization of the resin (step E). The plate thus obtained will then be cut to the dimensions desired (step F) for the sidewalls 6, 7 of the ski (step G).

If the sidewalls 6, 7 are made of a thermoplastic polymer material such as A.B.S., the metallic flakes are incorporated with the granules of polymer intended for making the A.B.S. plates by molding, in which the edges will be cut or sections will be obtained by extrusion.

Taking into account the fact that the lateral faces 8, 9 of the ski are made, with their conventional lower lateral flanges or projections 12, 13, by machining the lateral sides of the ski during the finishing operations consecutive to the molding of the ski, the metallic inclusions 11, and metallic flakes 18 become visible on these lateral faces, as is seen in FIG. 3.

As the inclusions are constituted by a metal of shiny appearance, the visual effect thus obtained is particularly striking, this visual effect tending to enhance the quality of this ski.

It should be noted that, over the whole visible surface of the two lower lateral flanges or projections 12, 13, this striking appearance is "renewed" whenever the edges 3, 4 are ground, as a fresh surface of the two lateral flanges or projections 12, 13 is then revealed.

Finally, the fact of including metallic elements of low density in the lateral reinforcing elements has the effects:

of increasing the Young's modulus of the sidewalls, therefore of improving the resistance to crushing and the bending of torsional strengths;

of increasing the resistance to abrasion without penalizing the aptitude of the two lower lateral flanges or projections 12, 13 to be machined during the finishing operations;

of obtaining an aesthetic effect and a persistant "technical" appearance, which a metallized (surface) paint could not have ensured after wear by abrasion.

The invention is not limited to the embodiment which has just been described.

The metal constituting these balls or flakes must be a corrosion-proof metal, and typically resistant to water and to air. The metallic particles chosen must be stainless. In that case, unlike other fibrous reinforcements, the metallic fillers are hydrophobic and there is therefore no risk of deterioration of the sidewalls by infiltration of water, which latter may in addition change into destructive particles of ice.

Moreover, it must have a shiny appearance. In order not to render the ski heavy, it is preferably of relatively low density with respect to steel or the other conventional metals.

Aluminium, or an aluminium alloy, or a copper alloy, or magnesium or zirconium oxides may, of course, be used to that end. It is possible to use a noble material, such as titanium or gold.

What is claimed is:

1. A process for producing rigid, distinct sidewalls for a ski or snow board, comprising:

covering a thin sheet of paper with a layer of a thermosettable resin, sprinkling said layer of said thermosettable resin with metallic particles, repeating these latter two operations a number of times in order to obtain a stack of coated sheets, compressing said stack and triggering polymerization of the resin, and cutting out said stack to predetermined dimensions of the sidewalls.

2. The process of claim 1, wherein the metallic particles are metallic particles resistant to corrosion from air and water.

3. The process of claim 1, wherein said metallic particles are metallic flakes.

4. The process of claim 3, wherein each of said metallic flakes has a length of between about 5 $\mu$m and 100 $\mu$m.

5. The process of claim 1, wherein said metallic particles are metallic balls.

6. The process of claim 5, wherein the metallic balls have a diameter up to about 100 $\mu$m.

7. The process of claim 1, wherein said metallic particles are of noble metal.

8. The process of claim 7, wherein said metallic particles are made of titanium.

9. The process of claim 7, wherein said metallic particles are of gold.

10. The process of claim 7, wherein said metallic particles are of zirconium.

* * * * *